US011837787B2

(12) United States Patent
Bencivenni

(10) Patent No.: US 11,837,787 B2
(45) Date of Patent: Dec. 5, 2023

(54) HIGH FREQUENCY FILTER AND PHASED ARRAY ANTENNA COMPRISING SUCH A HIGH FREQUENCY FILTER

(71) Applicant: GAPWAVES AB, Gothenburg (SE)

(72) Inventor: Carlo Bencivenni, Gothenburg (SE)

(73) Assignee: GAPWAVES AB, Gothenburg (SE)

( * ) Notice: Subject to any disclaimer, the term of this patent is extended or adjusted under 35 U.S.C. 154(b) by 441 days.

(21) Appl. No.: 17/271,235

(22) PCT Filed: Aug. 28, 2019

(86) PCT No.: PCT/EP2019/072959
§ 371 (c)(1),
(2) Date: Feb. 25, 2021

(87) PCT Pub. No.: WO2020/048845
PCT Pub. Date: Mar. 12, 2020

(65) Prior Publication Data

US 2021/0305667 A1 Sep. 30, 2021

(30) Foreign Application Priority Data

Sep. 4, 2018 (EP) ..... 18192512

(51) Int. Cl.
*H01Q 21/00* (2006.01)
*H01Q 23/00* (2006.01)
(Continued)

(52) U.S. Cl.
CPC ..... *H01Q 21/005* (2013.01); *H01P 3/123* (2013.01); *H01P 7/06* (2013.01); *H01Q 23/00* (2013.01)

(58) Field of Classification Search
CPC .. H01Q 21/06; H01Q 21/005; H01Q 21/0043; H01Q 23/00; H01P 1/207;
(Continued)

(56) References Cited

U.S. PATENT DOCUMENTS

2005/0264379 A1 12/2005 Obata
2017/0084971 A1 3/2017 Kildal

FOREIGN PATENT DOCUMENTS

JP 2005-341350 12/2005
JP 2017-519404 7/2017
(Continued)

OTHER PUBLICATIONS

International Search Report issued in PCT/EP2019/072959, dated Nov. 21, 2019, pp. 1-4.
Written Opinion issued in PCT/EP2019/072959, dated Nov. 21, 2019, pp. 1-6.
Vosoogh, "Wideband Cavity-Backed Slot Subarray with Gap Waveguide Feed-network for D-band Applications," 2017 11th European Conference on Antennas and Propagation (EUCAP) 978-88-907018-7-0/17, pp. 207-209.
(Continued)

*Primary Examiner* — Robert Karacsony
(74) *Attorney, Agent, or Firm* — Jeffrey S. Melcher; Melcher Patent Law PLLC

(57) ABSTRACT

A high frequency filter comprising a waveguide and at least one resonant cavity is disclosed. The waveguide is a so-called gap waveguide, and comprises a metal or metallized base layer, a lid arranged in parallel with said metal or metallized baser layer, a waveguiding structure in the form of a ridge, a groove or a microstrip line, and an artificial magnetic conductor arranged on said base layer, between the baser layer and the lid, and arranged aligned with said waveguiding structure to prevent waveguide propagation along other directions than along said waveguide structure. The filter further comprises at least one resonant cavity arranged within said baser layer, and extending essentially perpendicular to a plane of said baser layer. The filter may e.g. be used in a phased array antenna.

18 Claims, 3 Drawing Sheets

(51) Int. Cl.
*H01P 7/06* (2006.01)
*H01P 3/123* (2006.01)

(58) Field of Classification Search
CPC ..... H01P 1/208; H01P 1/2082; H01P 3/12; H01P 3/121; H01P 3/123; H01P 7/06; H01P 7/065
See application file for complete search history.

(56) References Cited

FOREIGN PATENT DOCUMENTS

| | | |
|---|---|---|
| WO | 2017/137224 | 8/2017 |
| WO | 2018/067046 | 4/2018 |

OTHER PUBLICATIONS

Nandi, "Millimeter Wave Contactless Microstrip-Gap Waveguide Transition Suitable for Integration of RF MMIC with Gap Waveguide Array Antenna," 2017 11th European Conference on Antennas and Propagation (EUCAP), 978-88-907018-7-0/17, pp. 1682-1684.

Brazelez, "Design of Millimeter-Wave Wideband Gap Waveguide Transitions Considering Integration into the Antenna System," Department of Signals and Systems, Chalmers University of Technology, Gothenburg, Sweden, astrid. algaba@chalmers.se, 9th European Conference on Antennas and Propagation, EuCAP 2015, Lisbon, Portugal, May 13-17, 2015, pp. 1-5.

Office Action issued in corresponding Japanese Patent Application No. 2021-510760, dated May 27, 2022, pp. 1-6, Translation pp. 1-8.

HIGH FREQUENCY FILTER AND PHASED ARRAY ANTENNA COMPRISING SUCH A HIGH FREQUENCY FILTER

TECHNICAL FIELD OF THE INVENTION

The present invention is related to a high frequency filter comprising a waveguide and at least one resonant cavity. It also relates to a phased array antenna comprising such a filter. In particular, it relates to a 2D massive MIMO, beam steering antenna. More specifically, the present invention is related to an RF/microwave/millimeter wave antenna having integrated electronics for beam control and transmit/receive functionality. Typical application areas for the antenna are telecommunication, automotive radar, radar for military or satellite applications.

BACKGROUND

Communication systems are requiring wider bandwidths all the time, and the millimeter wave region is needed to achieve these wide bandwidths. Further, such communication systems need filters to eliminate interference between adjacent bands. Waveguide filters are generally used for millimeter wave applications due to their relatively low loss. The recent rapid development of mobile communication systems and mobile communication terminals has brought a surge of data amount requested from the user side. This requires the mobile communication system to take more bandwidth from limited frequency resources, while such limitation has been addressed by an emerging technology that utilizes millimeter waves having wavelengths on the order of millimeters. The next-generation 5G system, for example, intends to use frequencies from 24 GHz to 60 GHz.

Processing of the millimeter waves requires waveguide filters which have been mainly used in technical fields such as defense industry and satellite communications. Furthermore, in a mobile communication system, a waveguide filter of a cavity type is used so as to be able to satisfy the requirements for high band and high performance filtering characteristics.

A waveguide filter is a filter that utilizes a resonance phenomenon due to the very structure of the waveguide, and the tubular waveguide is designed to have a length corresponding to its filtering frequency characteristic.

However, such waveguide filters are very costly and cumbersome to produce. The waveguide filters are extremely sensitive to machining tolerances. In other words, implementing a waveguide filter for processing millimeter waves requires extremely high processing accuracy in order to realize the designed structure into an actual product. For example, the machining tolerance of about 0.01 mm or less may be required. In order to compensate for machining tolerance, it is common to employ a structure in which a frequency tuning screw or the like is inserted into a resonance section of the resonance structure. However, such tuning functionality per se makes the waveguide filters more costly to produce, and also makes installation and assembly more tedious and costly.

Thus, at present the requirement of very precise machining tolerances aggravates the difficulty of machining work and lengthens the machining time, which results in an increase in machining costs, decreased production yield to render mass production difficult. This has set the very high market price of high performance waveguide filters.

In many applications, such as for phased array antennas, there is also considerable size restraints. Phased array antennas have been developed since late 1960's, however, their high complexity and cost has limited their use to mainly military applications. Wide angle scanning active arrays require a dense placing of the antenna elements and related components which pose several challenges. In particular, there is a need for a plurality of filters in phased array antennas, and the space available for each filter is very limited.

There is therefore a need for a new high frequency filter, which can be produced more precisely, with lower tolerances. There is also a need for high frequency filters with smaller dimensions. There is also a general need for low-cost, mass-producible filters. There is, thus, a need for a new high frequency filter which can be produced relatively cost-effectively, and which alleviates at least some of the above-discussed problems. There is also a need for a phased-array antenna including such filters.

SUMMARY OF THE INVENTION

The object of the present invention is therefore to provide a new high frequency filter, and a corresponding phased array antenna, which can be produced relatively cost-effectively, and which alleviates at least some of the above-discussed problems.

This object is achieved by a high frequency filter and a phased array antenna in accordance with the appended claims.

According to a first aspect of the present invention, there is provided a high frequency filter comprising a waveguide and at least one resonant cavity, wherein said waveguide comprises:

- a metal or metallized base layer;
- a lid arranged in parallel with said metal or metallized baser layer;
- a waveguiding structure in the form of a ridge, a groove or a microstrip line; and
- an artificial magnetic conductor (AMC) arranged on said base layer, between the baser layer and the lid, and arranged aligned with said waveguiding structure to prevent waveguide propagation along other directions than along said waveguide structure,
- wherein said at least one resonant cavity is arranged within said baser layer, and extending essentially perpendicular to a plane of said baser layer.

The present invention is based on the realization that forming a cavity directly in the base layer, perpendicular to the plane of the base layer, instead of e.g. above the base layer, as in many previously known solutions, is highly advantageous. Hereby, the cavity can be formed e.g. by drilling or similar machining in a very controlled way, thereby fulfilling the very precise dimensional requirements of the filter in a relatively cost-effective way. Hereby, filters can be cost-effectively produced, and still match the exact requirements for the filter, without the need for complicated and costly tuning mechanisms and the like. Since the assembly of lid on top of the waveguide does not significantly affect the properties of the filter, the assembling of the filter becomes simple and insensitive to tolerances. Thus, production of the new filter can be made fast, simple and cost-effective.

Thus, in the present invention, the resonant cavities are built vertically, instead of horizontally, as in conventional filters.

A further important advantage is that the filter becomes very compact in the width and length directions. This is of great advantage e.g. when many filters are to be arranged close to each other, such as in phased array antennas, wherein separate filters need to be provided for every radiating antenna element, or for a plurality of groups of antenna elements. Thus, available space in width and length directions is very limited, whereas the thickness is less sensitive. Since the filter of the present invention can be produced with very small width and length, and only somewhat thicker, than previously known filters, it is excellently suited for use in such applications.

Thus, the new filter is ideal for such applications, where the integration of compact, high-performance, high-frequency, robust and cost-effective components is challenging.

The new filter also provides very low losses, also at very high frequencies, such as above 1 GHz, and above 10 GHz.

The invention addresses the problem of integrating high-quality, high-frequency filters in a compact, robust and cost-effective way. The new filter develops longitudinally and may be manufactured of two layers only, avoiding bulky and sensitive multilayer assemblies. The thicker layer—the base layer—may accommodate the resonator(s) and feeding waveguiding structure, such as a ridge waveguide, while a smooth lid function as a cover. To greatly simplify manufacturing and assembly an Artificial Magnetic Conductor (AMC), e.g. in the form of a texture of pins, is used to package the filter, avoiding the need for a perfect electric contact between the layers.

The filter is preferably based on an end-coupled ridged vertical resonator. By adopting vertical cavities, the longitudinal dimension is minimized, enabling high order filters to be integrated in limited spacing. The cavity is preferably fitted with vertical ridges on the transversal side to reduce the corresponding dimension, such as to fit (together with the AMC) in half a wavelength, as needed for wide angle scanning arrays. Moreover, the presence of ridges in the cavity makes the wavelength inside the cavity longer, thereby reducing the depth of cavity.

Packaging with AMC makes the components more robust to mechanical and assembly tolerances. However, filters are particularly sensitive components and can experience degradation even to minimal defects. In the present invention, the provision of a vertical cavity, preferably obtained from a single solid block, and preferably with internal ridges in the cavity, so that the field is mostly confined inside the vertical ridges, the filter is significantly more robust to defects and imperfection across layers.

Moreover, a dual mode version of the resonator can also be realized by inserting an additional pair of ridges in the transversal direction, at the expense of a minor increase in the cavity length. This can be used to increase the filter order or decrease the total filter length for a fixed order.

The presented invention results in an extremely compact as well as robust and easy manufacturable filter with very high performance. The resonator geometry is ideal for integration in dense millimeter wave active antennas as it minimizes both the length and width of the structure, while adopting a single layer structure. As an example, a third order filter based even on the single mode resonator, including a row of pins, can fit just within a half wavelength in width and height and a one wavelength in length.

The artificial magnetic conductor preferably comprises a plurality of posts protruding from the plane of said base layer. The use of artificial magnetic conductors, such as protruding posts, to form a surface suppressing wave from propagating in unwanted directions is per se known from inter alia WO 10/003808, WO 13/189919, WO 15/172948, WO 16/058627, WO 16/116126, WO 17/050817 and WO 17/052441, all by the same applicant, and each of said documents hereby being incorporated in their entirety by reference.

The protruding posts preferably have a maximum cross-sectional dimensions of less than half a wavelength in air at the operating frequency, and/or a spacing between the protruding posts being smaller than half a wavelength in air at the operating frequency. Further, the protruding posts are preferably arranged in a periodic or quasi-periodic pattern and fixedly connected to the base layer. Preferably, the protruding posts are connected electrically to each other at their bases at least via said base layer. The protruding posts are also preferably monolithically connected with the base layer.

The use of protruding posts and other artificial magnetic conductors to form suppression of waves in unwanted directions may be referred to as gap waveguide technology, which is a technology used to control wave propagation in the narrow gap between parallel conducting plates, or to form surfaces suppressing wave propagation. The wave propagation is stopped by using periodic elements such as metal posts (also referred to as pins) in one or both of two parallel conductive surfaces, and in case a waveguide is to be formed, the waves are guided along e.g. metal ridges, arranged on one of the two conducting surfaces. No metal connections between the two parallel conductive surfaces are needed. The fields are mainly present inside the gap between the two surfaces, and not in the texture or layer structure itself, so the losses are small. This type of microwave waveguide technology is particularly advantageous for frequencies so high that existing transmission lines and waveguides have too high losses or cannot be manufactured cost-effectively within the tolerances required.

The filter preferably has an operating frequency of at least 1 GHz, and more preferably at least 10 GHz, and most preferably at least 20 GHz. For example, the filter may have an operating frequency of 28 GHz or above.

The waveguide structure may be in the form of a groove, e.g. formed on the base layer, or a microstrip, e.g. arranged on the lid. However, preferably the waveguide structure is in the form of a protruding ridge arranged on said base layer. This provides a very robust and effective waveguiding, and at the same time is relatively simple and cost-effective to manufacture.

The cavity may have a depth of about half a wavelength of the operating frequency.

The at least one resonant cavity may comprise at least one pair of protruding ridges, the ridges extending parallel to each other along the sides of the cavity in a direction essentially perpendicular to the plane of the base layer. The ridges make the cavity more efficient, and makes the wavelength inside the cavity longer, thereby making it possible to reduce the length of the cavity.

The at least one resonant cavity may also comprise two pairs of protruding ridges, the ridges extending parallel to each other along the sides of the cavity in a direction essentially perpendicular to the plane of the base layer, and the ridges in each pair being arranged opposite to each other. Hereby, the frequency band being passed through the filter becomes more distinct, and the edges sharper, thereby providing a more efficient filtering effect.

The protruding ridges preferably have a rectangular cross-section, with two opposite parallel side walls, and a top wall being orthogonal to the side walls, and with right angles between the top wall and the side walls. However, junction between the top walls and the side walls may alternatively be rounded edges, with a gradual transition. Further, the two side walls need not be exactly parallel to each other, but may e.g. both be slanted in a direction away from the top wall. Further, the top wall need not be entirely flat, but may also have a curved shape.

The sidewalls of the cavity are preferably generally planar and straight, apart from the protruding ridges. Preferably, the cavity has a generally rectangular cross-section, with four walls, two extending generally in the longitudinal direction of the waveguiding structure, and two extending generally transversely to the longitudinal direction of the waveguiding structure. The walls preferably form right angles between the walls. However, the transition between the walls may also be gradual and somewhat rounded.

The depth of the cavities is preferably about half a wavelength at the operating frequency. This means that the entire filter can be made very compact. The entire length of the filter can e.g. be 1-2 wavelengths, and preferably about one wavelength, and the width may be about half a wavelength, and the overall thickness may be about half a wavelength. For example, a filter for operation at 30 GHz, where the wavelength is about 10 mm, may have a length of 13 mm, a width of 5 mm, and a thickness of 6 mm. The resonant cavity would have a depth of about 5 mm.

The high frequency filter may comprise a plurality of resonant cavities, wherein the cavities differ in geometrical shape. The number of resonant cavities may e.g. be 2, 3, 4 or 5. Preferably, 3-5 resonant cavities are provided. However, even more cavities may be used for certain applications, such as 10 or more, 20 or more, 50 or more, or even 100 or more. The resonant cavities may e.g. differ in depth, and or distance between the internal opposed protruding ridges.

In one embodiment, the waveguide structure is a ridge, and the artificial magnetic conductor is in the form of protruding posts surrounding said ridge and arranged to stop wave propagation in other directions than along said ridge.

In one embodiment, the artificial magnetic conductor is in the form of posts protruding from the base layer, and wherein the protruding posts of the base layer have maximum cross-sectional dimensions of less than half a wavelength in air at the operating frequency, and/or wherein the protruding posts are spaced apart by a spacing being smaller than half a wavelength in air at the operating frequency.

In one embodiment, the artificial magnetic conductor is in the form of protruding posts of the base layer, and being arranged in a periodic or quasi-periodic pattern and fixedly connected to the base layer.

In one embodiment, the artificial magnetic conductor is in the form of protruding posts arranged on the base layer, and wherein the protruding posits of the base layer are connected electrically to each other at their bases at least via said base layer. Preferably at least some, and most preferably all, of the protruding posts are in mechanical contact with the lid.

The base layer, including said at least one resonant cavity is preferably formed as a solid, monolithic piece. The bottom of the cavity may be provided by an additional layer, connected to the base layer on the surface opposite to the waveguiding structure. However, preferably the bottom is also formed as an integrated, monolithic part of the base layer.

The base layer is preferably entirely made of metal, and most preferably of aluminum. The AMC, e.g. in the form of protruding posts, may be provided separately, and be connected to the base layer by welding, adhesive or the like. However, preferably the AMC, e.g. in the form of protruding posts, is formed integrated and monolithically with the base layer, e.g. by die casting or injection molding. The cavities in the base layer may also be formed by die casting or injection molding, but may alternatively be made by drilling or other type of machining.

According to another aspect of the present invention there is provided a phased array antenna comprising a high frequency filter as discussed in the foregoing.

Preferably, the phased array antenna comprises a plurality of high frequency filters, and most preferably one filter for each antenna element.

The phased array antenna may be of different types, as per se known in the art. However, in one embodiment, the phased array antenna is of the type disclosed in EP application no. 17192899.7 by the same applicant, said document hereby being incorporated in its entirety by reference.

Thus, according to one embodiment, the phased array antenna comprises:

- a bottom layer comprising a substrate with a plurality of protruding posts, said posts for stopping wave propagation along said base layer;
- a printed circuit board (PCB) arranged on said bottom layer, and comprising at least one phased array radio frequency (RF) integrated circuit (IC) on a first side of the PCB facing the bottom layer and the protruding posts, the PCB further comprising feeds for transferring of RF signals from the high-frequency phased array RF IC(s) to an opposite second side of the PCB;
- a radiating layer, comprising a plurality of radiating elements for transmitting and/or receiving RF signals from the phased array antenna;
- a feeding layer for transfer of RF signals, arranged between the feeds of the PCB on the second side and the radiating elements of the radiating layer.

The high-frequency filter, or preferably a plurality of high-frequency filters, may be arranged in at least one filter layer, e.g. arranged between the PCB and the feeding layer. Since the other layer also includes gap waveguides, the filter can be incorporated with very low losses in the transmit/receive path, for suppressing noise and the like.

However, the filters may also be used in other types of antennas, and in particular other active antennas, such as dense millimeter wave active antennas. The filter may also be used for other high-frequency applications. The filter is in particular suited for use in the areas of telecommunications, automotive radar and radar for military or satellite applications.

Further embodiments and advantages of the present invention will become apparent from the following detailed description of presently preferred embodiments of the invention.

BRIEF DESCRIPTION OF THE DRAWINGS

For exemplifying purposes, the invention will be described in closer detail in the following with reference to embodiments thereof illustrated in the attached drawings, wherein.

DETAILED DESCRIPTION

Figure 1:
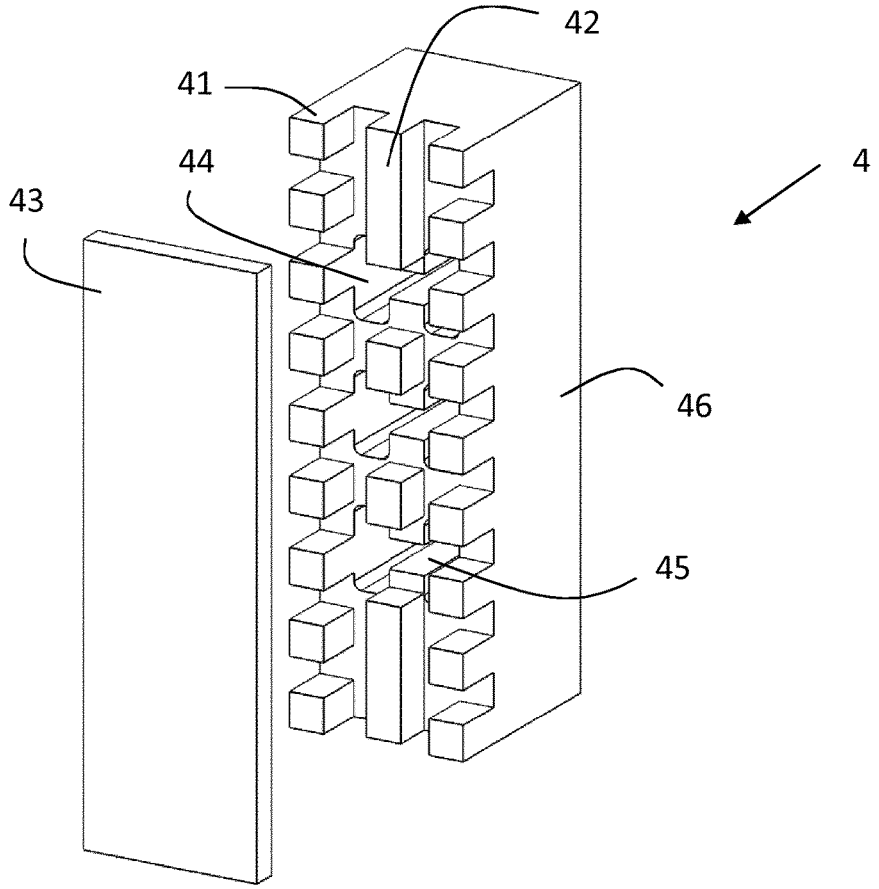
FIG. 1 is an exploded perspective view of a third order filter with single mode resonators, in accordance with an embodiment of the present invention.

In the following detailed description preferred embodiments of the invention will be described. However, it is to be understood that features of the different embodiments are exchangeable between the embodiments and may be combined in different ways, unless anything else is specifically indicated. It may also be noted that, for the sake of clarity, the dimensions of certain components illustrated in the drawings may differ from the corresponding dimensions in real-life implementations of the invention, and the relative dimensions may also be different, etc.

A high frequency filter 4, as shown in FIG. 1, comprises a base layer 46, on which a waveguiding structure is provided. The waveguiding structure is here in the form of a ridge 42. An artificial magnetic conductor (AMC) is arranged on both sides of the ridge 42. The AMC is here in the form of protruding posts 41, and at least one row of periodically or quasi-periodically distributed posts are provided on each side of the ridge 42, and extending along lines parallel to the ridge.

A lid 43 is provided, and is, when assembled, placed in mechanical contact with the protruding posts. The lid may also be electrically connected to the posts, but this is not necessary.

The lid and the base layer hereby forms a gap waveguide, in which waves can be transmitted along the ridge 42, and where the protruding posts prevent propagation along other directions than along the ridge.

Both the lid and the base layer may be formed entirely by metal, such as aluminum, but may alternatively be made of other materials which are provided with a metallized outer surface towards the waveguide.

The lid may be provided as a separate element, as shown in FIG. 1, but may also be the bottom of another layer of an assembled product, such as an antenna. The surface of the lid facing the waveguide is preferably smooth and planar.

The base layer 46 further comprises at least one resonant cavity 44, centrally arranged in the waveguiding path, and extending essentially perpendicular to a plane of the baser layer. The cavity has a bottom, and the depth of the cavity is preferably about half a wavelength of the operating frequency. The bottom of the cavity may be formed by an additional layer, such as a separate bottom layer, or the surface of another layer of an assembled product. However, preferably the bottom is formed as an integral, monolithic part of the base layer.

The base layer is preferably formed as a solid, monolithic block, including both the ridge, the posts and the resonant cavity.

The filter may comprise a plurality of resonant cavities, wherein the cavities differ in geometrical shape. In the illustrative example, three resonant cavities are provided, providing third order filter. However, more or fewer resonant cavities may also be used.

The resonant cavity may also comprise at least one pair of protruding ridges 45, the ridges extending parallel to each other along the sides of the cavity in a direction essentially perpendicular to the plane of the base layer. More specifically, as shown in FIG. 1, the internal ridges are here provided centrally at the walls extending in a direction perpendicular to the waveguiding direction. The ridges 45 hereby runs in the same plane as the waveguiding ridge 42.

The operating frequency of the filter may be at least 1 GHz, and preferably at least 10 GHz, and most preferably at least 20 GHz.

Figure 2:
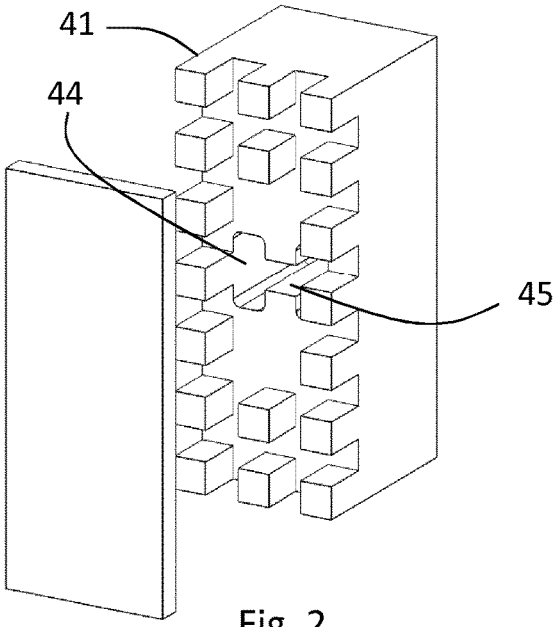
FIG. 2 is a schematic exploded perspective view of a single mode resonator, for use in a filter in accordance with an embodiment of the present invention.

In FIG. 2, an alternative realization of the resonator is shown. Here, the resonant cavity 44 is shaped similar to the one discussed in relation to FIG. 1, with a single pair of internal ridges 45. However, in this resonator in FIG. 2, only one resonant cavity is provided, thereby forming a first order, single mode resonator.

Figure 3:
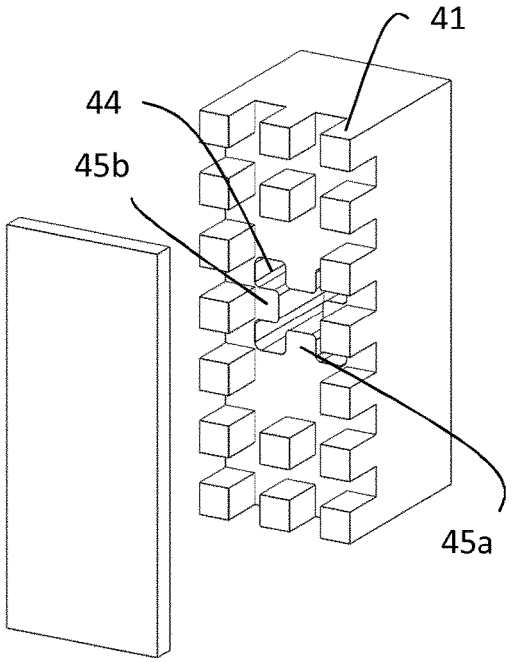
FIG. 3 is a schematic exploded perspective view of a dual mode resonator, for use in a filter in accordance with an embodiment of the present invention.

In FIG. 3, another alternative realization of the resonator is shown. Here, the resonant cavity 44 is shaped similar to the one discussed in relation to FIG. 1, but with two pairs of internal ridges 45*a* and 45*b*. The first pair of internal ridges 45*a* are arranged along the waveguiding direction, whereas the second pair of internal ridges 45*b* are arranged along a line perpendicular to the waveguiding direction. Hereby, dual mode resonator is provided.

Figure 4A:
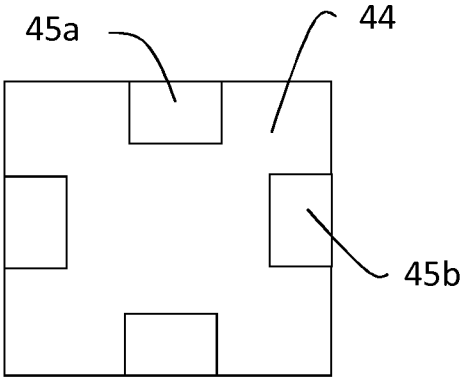
FIGS. 4*a* and *b* are top view schematically illustrating two alternative configurations of a resonating cavity, for use in a filter in accordance with embodiments of the present invention.

The sidewalls of the cavity are preferably generally planar and straight, apart from the protruding ridges. Preferably, the cavity has a generally rectangular cross-section, with four walls, two extending generally in the longitudinal direction of the waveguiding structure, and two extending generally transversely to the longitudinal direction of the waveguiding structure. The walls preferably form right angles between the walls. Such an embodiment is shown schematically in FIG. 4*a*.

Figure 4B:
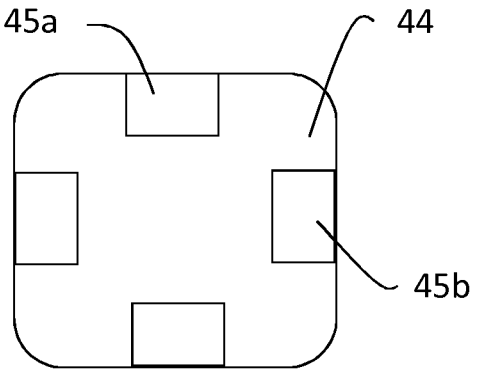

However, the transition between the walls may also be gradual and somewhat rounded, thereby providing a rectangle with rounded corners, as shown schematically in FIG. 4*b*.

Figure 5A:
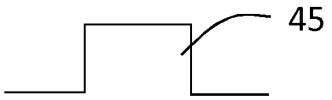
FIGS. 5*a-d* are schematic cross-sectional illustrations of various possible shapes of the internal protruding ridges in the resonating cavity, for use in a filter in accordance with embodiments of the present invention.

The protruding ridges 45 preferably have a rectangular cross-section, with two opposite parallel side walls, and a top wall being orthogonal to the side walls, and with right angles between the top wall and the side walls. Such an embodiment is schematically illustrated in FIG. 5*a*.

Figure 5B:
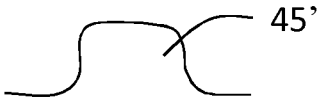

However, the junction between the top walls and the side walls may alternatively be rounded edges, with a gradual transition. There may, additionally or alternatively, be a rounded transition between the side walls and the side of the cavity. Such ridge 45' is schematically illustrated in FIG. 5*b*.

Figure 5C:
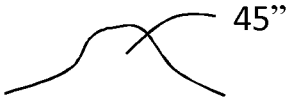

Further, the two side walls need not be exactly parallel to each other, but may e.g. both be slanted in a direction away from the top wall. Further, the top wall need not be entirely flat, but may also have a curved shape. Such a ridge 45" is schematically illustrated in FIG. 5*c*.

Figure 5D:
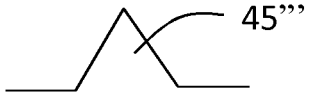

Still further, the ridge may also have other shapes. In FIG. 5*d*, an alternative shape in the form of a triangle of the ridge 45'" is schematically illustrated. However, many other shapes are also feasible, as would be appreciated by the skilled reader.

Figure 6A:
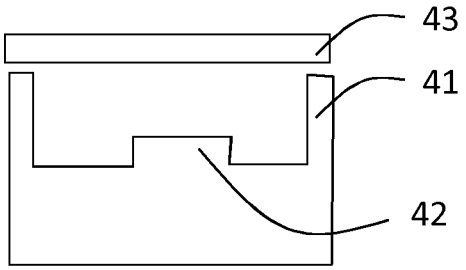
FIGS. 6*a-c* are schematic cross-sectional illustrations of various waveguiding structures for use in a filter in accordance with embodiments of the present invention.

In the above-discussed embodiments, the waveguide comprises a waveguiding structure in the form of a ridge 42, extending between the rows of posts 41, or any other type of AMC. This is also schematically illustrated in FIG. 6*a*.

Figure 6B:
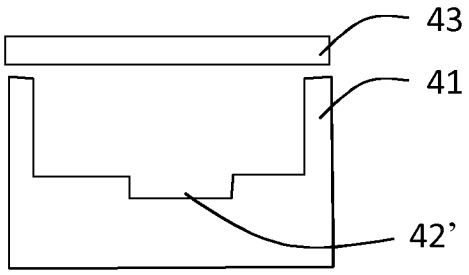
Figure 6C:
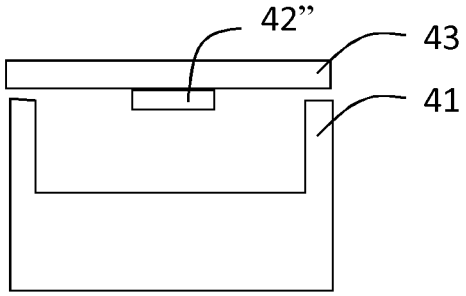

However, other types of waveguiding structures are also feasible. For example, the waveguiding structure may be in the form of a groove 42' formed in the base layer, and extending between the AMC in the same way as the ridge 42. Such an embodiment is schematically illustrated in FIG. 6*b*. Further, the waveguiding structure may be in the form of a microstrip line 42", preferably arranged on the lid, on the surface facing the waveguide. Such an embodiment is schematically illustrated in FIG. 6*c*.

Such and other alternatives regarding the waveguiding structure and the AMC for forming gap waveguides are per se known, and e.g. discussed in detail in WO 10/003808, WO 13/189919, WO 15/172948, WO 16/058627, WO 16/116126, WO 17/050817 and WO 17/052441, all by the same applicant, and each of said documents hereby being incorporated in their entirety by reference.

The above discussed filters are end-coupled filters, where the waves/signals are input at one end, and output at the other end of the waveguide. However, the same principles may be used also for filters where the input and/or output occurs from one of the sides, from the top, or from the bottom.

The filters may be used in various types of high-frequency equipment and products. In particular, it is highly suitable for use in active antennas, and in particular phased array antennas.

An example of such a phased array antenna in which the new filters may be used is the type of antenna disclosed in EP application no. 17192899.7 by the same applicant, said document hereby being incorporated in its entirety by reference.

Figure 7:
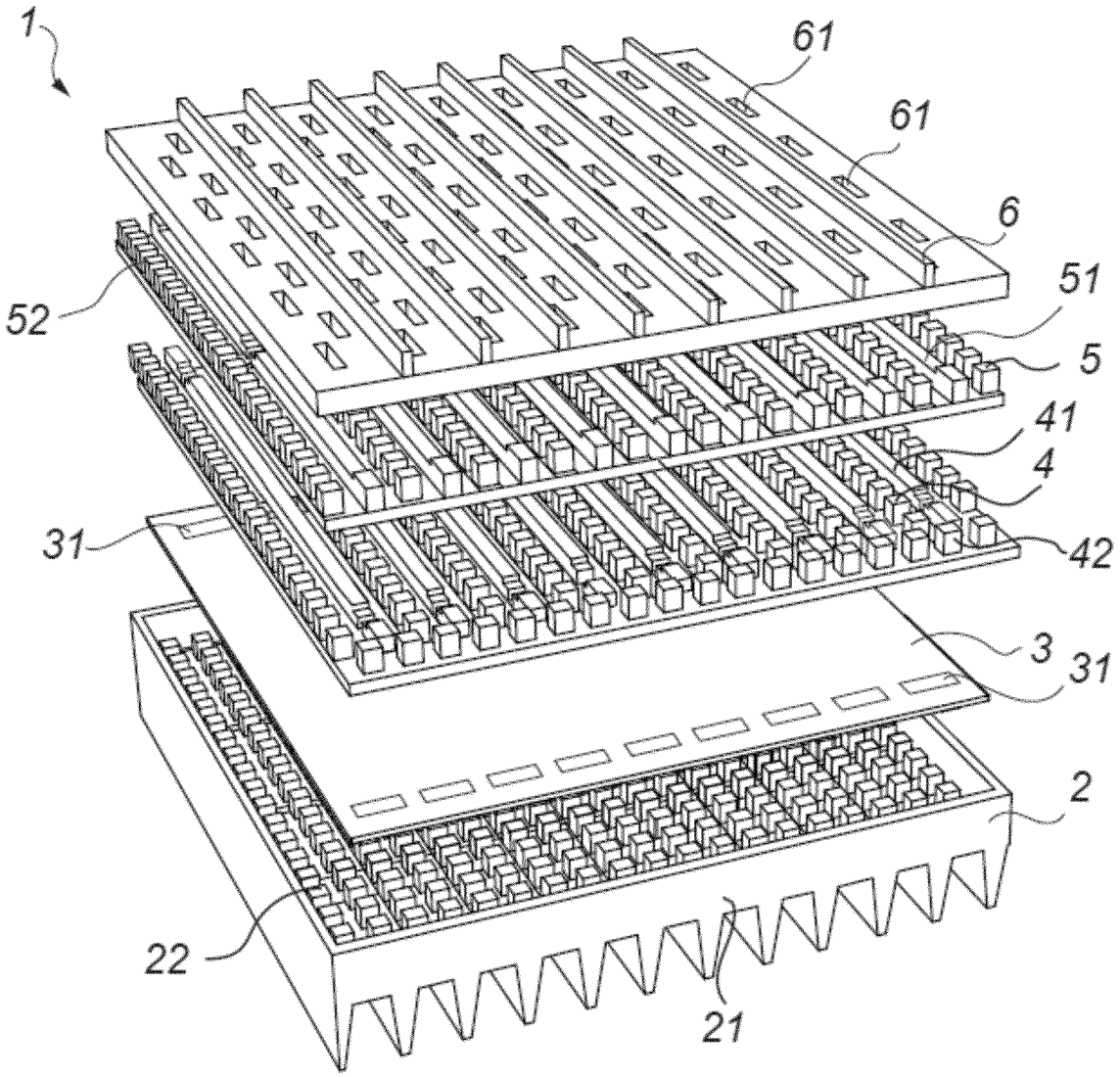
FIG. 7 is an exploded view of a phased array antenna in accordance with an embodiment of the present invention.

An embodiment of this antenna is illustrated in FIG. 7. With reference to FIG. 7, the phased array antenna 1 comprises a baser layer 2. The base layer comprises a substrate 21 with a plurality of protruding posts 22, for stopping wave propagation along the base layer. The protruding posts may be arranged in a periodic or quasi-periodic pattern, and preferably have maximum cross-sectional dimensions of less than half a wavelength in air at the operating frequency, and a spacing between the protruding posts which is smaller than half a wavelength in air at the operating frequency. The protruding posts are fixedly connected to the substrate, and are also electrically connected to each other via said substrate. The substrate and the protruding posts have a conductive metal surface, and are preferably made entirely by metal. For example, the base layer could be die casted or injection molded of aluminium or zinc. The protruding posts 22 can e.g. have a rectangular or circular cross-sectional shape.

A printed circuit board (PCB) 3 is arranged on the base layer. The PCB preferably comprises one side, a component side, comprising electronic components, and more specifically at least one phased array radio frequency (RF) integrated circuit (IC), and another side comprising a ground layer. The component side is here arranged towards the base layer and the protruding posts.

The PCB further comprises feeds 31 for transferring of RF signals from the phased array RF IC(s) to the opposite side of the PCB. Here, the feeds comprise slot openings through the PCB. The electronics mounted on the PCB couples to the slot openings e.g. from open end microstrip lines extending into the slot openings.

Filters 4 are arranged as a filter layer, and may be arranged on the PCB layer 3. The filter layer comprises a plurality of filters of the type discussed in the foregoing, and arranged side-by-side in rows and columns.

A feeding layer 5 is arranged on the filter layer 4. The feeding layer 5 transfers RF signals coming from the feeds of the PCB, and via the filter layer, to radiating elements of a radiating layer, or in the reverse way. In this embodiment, the feeding layer is realized as a gap waveguide structure, comprising ridges 51 along which the signals are to propagate, and protruding posts 52 arranged to stop or suppress wave propagation in other directions, in the same way as discussed in the foregoing. The protruding posts are preferably arranged in at least two parallel rows on both sides along each waveguiding path. However, for some applications, a single row may suffice. Further, more than two parallel rows may also advantageously be used in many embodiments, such as three, four or more parallel rows.

The feeds 31 of the PCB layer, and the corresponding openings/inputs in the feeding layer 5, or in the filter layer 4 in case such a layer is provided, may be arranged along two lines, arranged close to two opposing sides of the PCB. This will feed signals in parallel lines in the feeding layer, from the sides of the feeding layer and towards the center. However, alternatively the feeds may be arranged along one or more center lines, or one or several lines arranged relatively close to the center. This will feed signals in parallel lines in the feeding layer from the center and outwards, towards the sides. It is also possible to provide three or four parallel lines of feeds 31, arranged separated and distributed over the PCB. However, other arrangements of the feeds are also feasible.

A radiating layer 6 is arranged on the feeding layer 5, and comprises a plurality of radiating elements 61, arranged as an array. The radiating elements are arranged to transmit and/or receive RF signals. The radiating layer preferably forms a planar radiating surface.

In this embodiment, the radiating elements are slot openings extending through the radiating layer, and arranged to be coupled to the gap waveguides of the feeding layer 5. The slot openings are preferably relatively short, and arranged along parallel lines in the radiating layer, each line comprising a plurality of slot openings.

Preferably, one filter 4 is provided for each radiating element 61.

The antenna of the present invention may be used for either transmission or reception of electromagnetic waves, or both.

The antenna is preferably flat, and with an essentially rectangular shape. However, other shapes are also feasible, such as circular, oval are also feasible. The shape may also be in the form of a hexagon, octagon or other polygons. The antenna surface may also be non-planar, such as being convex in shape.

In addition to the above-discussed layers of the phased array antenna, the antenna may also comprise additional layers, such as support layers, spacing layers etc, arranged above or below the previously discussed arrangement of layers, or between any of these layers. There may also be provided more than one PCB layers, e.g. arranged on top of each other, in a sandwiched construction, or arranged with other layers there between.

The waveguides of the antenna and/or the filter may be filled with a dielectric material, such as dielectric foam, for mechanical reasons. However, preferably at least some, and preferably all, the waveguides are filled with air, and free from dielectric material.

The protruding posts may have any cross-sectional shape, but preferably have a square, rectangular or circular cross-sectional shape. Further, the protruding posts preferably have maximum cross-sectional dimensions of smaller than half a wavelength in air at the operating frequency. Preferably, the maximum dimension is much smaller than this. The maximum cross-sectional dimension is the diameter in case of a circular cross-section, or diagonal in case of a square or rectangular cross-section. The plurality of protruding posts may also be referred to as a pin grid array.

The protruding posts are all preferably fixed and electrically connected to one conductive surface. However, at least some, and preferably all, of the protruding elements may further be in direct or indirect mechanical contact with the surface arrange overlying the protruding posts, and in particular the lid 43.

Such and other obvious modifications must be considered to be within the scope of the present invention, as it is defined by the appended claims. It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting to the claim. The word "comprising" does not exclude the presence of other elements or steps than those listed in the claim. The word "a" or "an" preceding an element does not exclude the presence of a plurality of such elements. Further, a single unit may perform the functions of several means recited in the claims.

The invention claimed is:

1. A high frequency filter comprising a waveguide and at least one resonant cavity, wherein said waveguide comprises:

a metal or metallized base layer;

a lid arranged in parallel with said metal or metallized base layer;

a waveguiding structure in the form of a ridge, a groove or a microstrip line; and an artificial magnetic conductor arranged on said base layer, between the base layer and the lid, and arranged aligned with said waveguiding structure to prevent waveguide propagation along other directions than along said waveguide structure, wherein said at least one resonant cavity is arranged within said base layer, and extending perpendicular to a plane of said base layer.

2. The high frequency filter of claim 1, wherein the filter has an operating frequency of at least 1 GHz.

3. The high frequency filter of claim 1, wherein the artificial magnetic conductor comprises a plurality of posts protruding from the plane of said base layer.

4. The high frequency filter of claim 1, wherein the waveguide structure is in the form of a protruding ridge arranged on said base layer.

5. The high frequency filter of claim 1, wherein the at least one resonant cavity has a depth of about half a wavelength of the operating frequency.

6. The high frequency filter of claim 1, wherein the at least one resonant cavity comprises at least one pair of protruding ridges, the ridges extending parallel to each other along the sides of the cavity in a direction perpendicular to the plane of the base layer.

7. The high frequency filter of claim 1, wherein the at least one resonant cavity comprises two pairs of protruding ridges, the ridges extending parallel to each other along the sides of the cavity in a direction perpendicular to the plane of the base layer, and the ridges in each pair being arranged opposite to each other.

8. The high frequency filter of claim 6, wherein the distance between the ridges within said at least one pair of ridges is about half a wavelength at the operating frequency.

9. The high frequency filter of claim 1, comprising a plurality of resonant cavities, wherein the cavities differ in geometrical shape.

10. The high frequency filter of claim 1, wherein the artificial magnetic conductor is in the form of posts protruding from the base layer, and wherein the protruding posts of the base layer have maximum cross-sectional dimensions of less than half a wavelength in air at the operating frequency, and/or wherein the protruding posts are spaced apart by a spacing being smaller than half a wavelength in air at the operating frequency.

11. The high frequency filter of claim 1, wherein the artificial magnetic conductor is in the form of protruding posts of the base layer, and being arranged in a periodic or quasi-periodic pattern and fixedly connected to the base layer.

12. The high frequency filter of claim 1, wherein the artificial magnetic conductor is in the form of protruding posts arranged on the base layer, and wherein the protruding posits of the base layer are connected electrically to each other at their bases at least via said base layer.

13. The high frequency filter of claim 12, wherein at least some of the protruding posts are in mechanical contact with the lid.

14. The high frequency filter of claim 1, wherein the base layer, including said at least one resonant cavity is formed as a solid, monolithic piece.

15. A phased array antenna comprising a high frequency filter of claim 1.

16. The high frequency filter of claim 2, wherein the filter has an operating frequency of at least 10 GHz.

17. The high frequency filter of claim 2, wherein the filter has an operating frequency of at least 20 GHz.

18. The high frequency filter of claim 12, wherein all of the protruding posts are in mechanical contact with the lid.

* * * * *